US007338333B2

(12) United States Patent
Norden

(10) Patent No.: US 7,338,333 B2
(45) Date of Patent: Mar. 4, 2008

(54) ELECTRICAL CONNECTORS (II)

(76) Inventor: Alexander Roy Norden, 250 S. Ocean Blvd., Boca Raton, FL (US) 33432

( * ) Notice: Subject to any disclaimer, the term of this patent is extended or adjusted under 35 U.S.C. 154(b) by 0 days.

(21) Appl. No.: 11/144,959

(22) Filed: Jun. 3, 2005

(65) Prior Publication Data

US 2006/0276084 A1 Dec. 7, 2006

(51) Int. Cl.
*H01R 4/36* (2006.01)

(52) U.S. Cl. ..... 439/814; 439/798

(58) Field of Classification Search ..... 439/814, 439/798, 797, 795, 796, 799, 800, 801, 803, 439/921

See application file for complete search history.

(56) References Cited

U.S. PATENT DOCUMENTS

| | | | | |
|---|---|---|---|---|
| 3,133,779 | A | 5/1964 | Stanback | |
| 3,794,963 | A | 2/1974 | Cooper | |
| 4,053,202 | A * | 10/1977 | Norden | 439/814 |
| 4,214,806 | A | 7/1980 | Kraft | |
| 4,382,651 | A | 5/1983 | Klosin et al. | |
| 4,427,258 | A | 1/1984 | Mueller | |
| 5,690,516 | A | 11/1997 | Fillinger | |
| 6,042,430 | A * | 3/2000 | Hollick | 439/797 |
| 6,579,131 | B1 * | 6/2003 | Ashcraft et al. | 439/798 |
| 6,769,941 | B2 | 8/2004 | Norden | |
| 7,014,514 | B2 * | 3/2006 | Zahnen | 439/798 |
| 2002/0094729 | A1 | 7/2002 | Triantopoulos et al. | |
| 2004/0087220 | A1 * | 5/2004 | Norden | 439/798 |

* cited by examiner

*Primary Examiner*—P. Austin Bradley
*Assistant Examiner*—Edwin A. Leon
(74) *Attorney, Agent, or Firm*—Stroock & Stroock & Lavan LLP

(57) ABSTRACT

The electrical connectors according to embodiments of the present invention include an elongated conductor body having an external contact surface, and a clamping device including a nut plate that spans the contact surface and carries a clamping screw for securing a threaded stud terminal to the contact surface. The nut plate and the conductor body are segments cut from stocks of metal extrusions. The body extrusion has one or more longitudinal ribs that are converted by coining into one or more rows of teeth that mesh with the stud terminal to block shift of the connector along the stud terminal.

6 Claims, 7 Drawing Sheets

ELECTRICAL CONNECTORS (II)

The present invention relates to electrical connectors for connecting a stud terminal of electrical equipment to multiple branch circuits, more particularly to connectors of the types in my U.S. Pat. No. 6,769,941 issued Aug. 3,2004 ("the '941 patent" referenced below). A transformer is the electrical equipment for which these connectors are intended, but they may be useful in other applications.

BACKGROUND OF THE INVENTION

A variety of connectors for connecting multiple branch circuits to a threaded stud terminal of electrical equipment commonly have an end bore in the connector body to receive the stud terminal. There are two forms of such connectors: the "screw-on" form and the "slip-fit" form. Commonly, the bore in the connector body of a slip-fit connector is oversize, so that it is unnecessary to twist the connector onto the stud terminal to its desired position when being assembled onto the threaded stud terminal.

In the foregoing connectors, provision has been made for preventing the connector from being pulled off the stud terminal in case wiring that is fixed to the connector were jostled. The bore is threaded in some connectors and, after the connector has been placed in its desired position along the stud terminal, the threaded stud terminal is tightened in mesh with one side of the threaded bore, which prevents inadvertent removal of the connector from the stud terminal.

There is no need here to go into detail with respect to the shortcomings and complications of the known connectors, inasmuch as the present connector and its method of manufacture are distinctive and unobvious.

SUMMARY OF THE INVENTION

Here, as in my '941 patent, the connector involves two main metal parts: a body and a clamping plate, hereinafter called a "nut plate". The body and, advantageously, the nut plate are cut segments of respective metal extrusions, and each cut extension segment is modified by secondary machining operations to attain its finished form. Both here and in my '941 patent, an external side surface of the cut extension segment that forms the connector body (the "body extrusion") provides an electrical contact area engaged by the stud terminal. In the course of becoming a "slip-fit" assembly, the stud terminal and the contact area of the connector body are brought into confrontation. A screw or screws threaded through the nut plate drive(s) the stud terminal against the contact area.

That external contact area is in sharp contrast to the internal side surface of a threaded bore found in comparable connectors. The body of the present connector, in its illustrative forms shown in the drawings and described below, provides a concave contact area against which the stud terminal is laid, and the spiral crest of the stud terminal's thread is securely clamped against the contact area of the body.

In producing the body extrusion, a concave contact area is formed along an external side surface of the stock of the body extrusion and a longitudinal rib or multiple ribs is (are) formed, projecting inward of the concave contact area. Deformations of the rib(s) by a punch or die form gaps that convert each of the rib(s) into a succession or successions of thread segments or teeth. When the stud terminal is laid against the contact area, the thread segments or teeth are received in the spiral groove of the threaded stud terminal, blocking inadvertent endwise shift of the connector along the stud terminal.

Forming the concave contact area and the rib or ribs is incidental to producing the stock of body extrusion, entailing no expense. Converting the rib or rib(s) into a succession or successions of teeth can be performed economically by a punch or die in a quick coining or impact stroke.

In my '941 patent, the contact area is on an external side surface of the body of the connector. A drill or an end mill and thereafter a tap may be used to provide arcuate grooves in an external side surface of the extrusion. Those arcuate grooves produced by the tap receive and become interlocked with the stud terminal's threads, preventing inadvertent removal of the connector from the stud terminal. In those operations, the cuffing actions of the drill or the end mill and of the tap occur at only one side of the tools'axes, resulting in enormous tool-deflecting forces that tend to cause distortions in the product. Those machining operations require heavy equipment, resulting in high cost.

The row or rows of teeth in the present connectors and the method by which they are produced are eminently practical and effective for their purpose.

The illustrative forms of connectors described in detail below and shown in the accompanying drawings are adapted for use with either a 1"-14 or a ⅝"-11 stud terminal. Of course, the novel connectors may be designed for use with only one size of stud terminal, and then the body extrusion would be dedicated to that one size of stud terminal.

BRIEF DESCRIPTION OF THE DRAWINGS SHOWING THREE ILLUSTRATIVE CONNECTORS AND THEIR METHOD OF MANUFACTURE

FIG. 1 is an elevation of the first illustrative electrical connector mounted on a stud terminal of a transformer;

FIG. 2 is a view of the connector of FIG. 1, looking upward from plane 2-2 in FIG. 1;

FIG. 3 is a duplicate of FIG. 1, revealing a stud terminal which is concealed by a nut plate in FIG. 1;

FIG. 4 is an elevation of the body extrusion forming a component of FIGS. 1-3;

FIG. 5 is a greatly enlarged portion of the body extrusion shown in FIG. 2 in its condition as extruded, i.e., as shown in FIG. 7;

FIG. 6 is a diagrammatic greatly reduced representation of a stock of metal extrusion for the body of the connector of FIG. 1 and a cut segment of that metal stock, noting the secondary operations involved in attaining the finished condition.

FIG. 7 is an end view of the stock of metal extrusion for the connector body of FIG. 1, being drawn to the same scale as FIG. 2; and FIG. 8 is a simplified view of a punch or die that may be used for converting the rib or ribs at the bottom of the channel of FIG. 7 into teeth as represented in FIG. 3A.

FIG. 9 is a front elevation of the second novel connector omitting its nut plate;

FIG. 10 is a left-hand side elevation of the connector of FIG. 9 including its nut plate;

FIG. 11 is a bottom view of FIG. 10; and

FIG. 12 is a bottom view of FIG. 9.

FIG. 13 is a front elevation of the third electrical connector;

FIG. 14 is a bottom view of FIG. 13; and

FIG. 15 is a right-side elevation of FIG. 13.

DETAILED DESCRIPTION OF THE ILLUSTRATIVE EMBODIMENTS OF THE INVENTION

Figure 1:
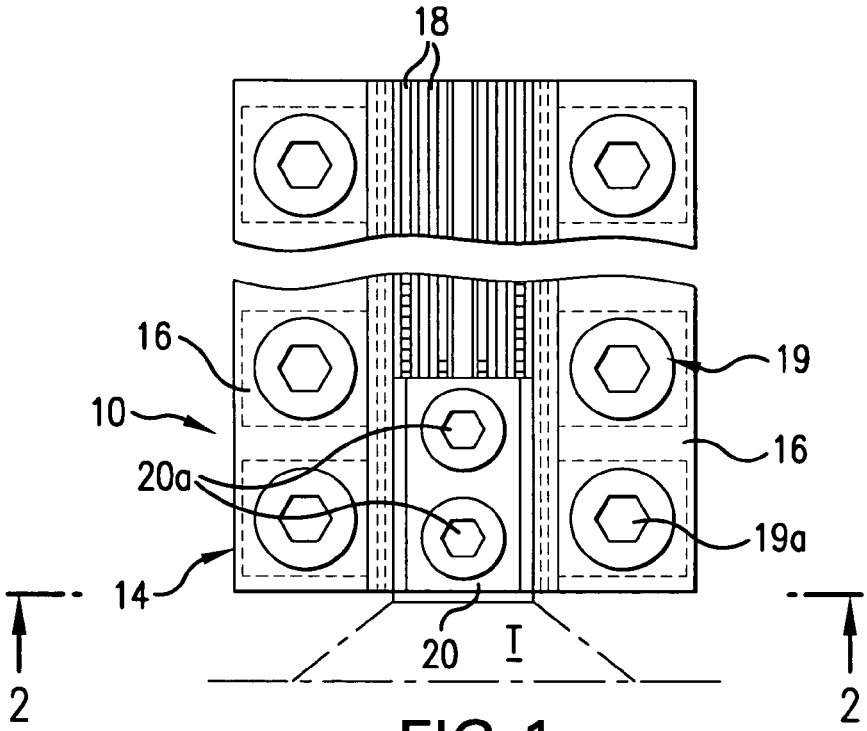
FIGS. 1-8 Illustrate a First Novel Electrical Connector and Steps Used in its Manufacture.
Figure 2:
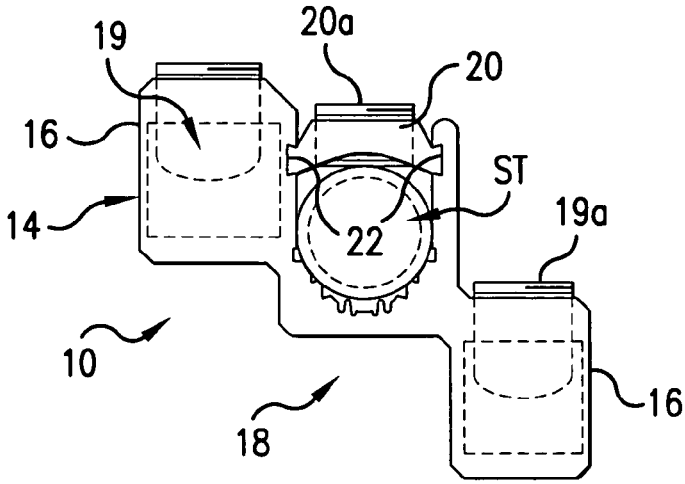
Figure 3:
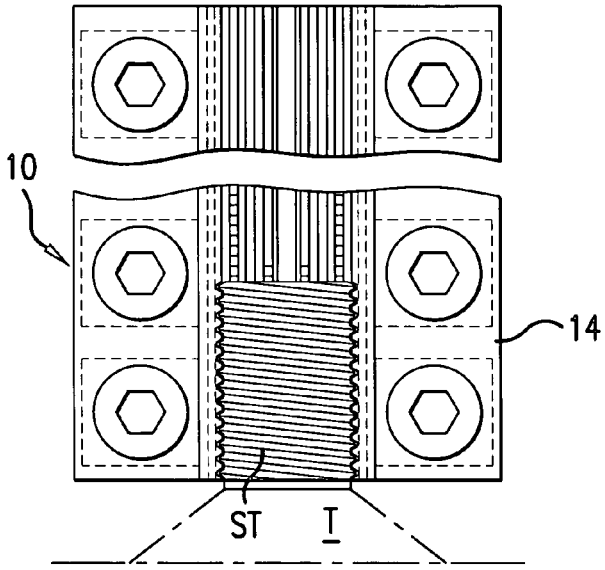

FIGS. 1-3 show a novel connector 10 which is in a form to be used with either of two standard sizes of stud terminals, 1"-14 or ⅝"-11. In the illustrative form of equipment, the stud terminals of the transformer T are of limited length; they extend upward from the transformer to only a short height. The extent of the row(s) of teeth 26*a* and 30*a* (FIG. 4) are of correspondingly limited length.

Connector 10 in FIG. 2 is mounted on a stud terminal ST (shown in phantom) of a transformer T. Elongated portions 16 extending from the sides of channel 18 are integral parts of body extrusion 14, the body extrusion being a cut segment 14*a* (FIG. 6) of a stock of extrusion 14*b*. The bottom 18*a* of channel 18 provides the "external side contact area" of the body extrusion. That external contact area is open and freely accessible to be confronted by a stud terminal in mounting the connector on the stud terminal, and it is also freely accessible for engagement by a punch or die in the tooth-forming operation (described below), by punch P in phantom in FIG. 7. The metal of the body extrusion is a standard aluminum alloy widely used for electrical components. A series of securing devices 19 for branch circuit wires is formed in each portion 16 of the body extrusion. In the form shown in FIGS. 1-3, each of the wire-securing devices comprises a pair of cross-drilled bores—$D_{wh}$ (Drill, wire hole) and $D_{sh}$ (Drill, screw hole), the latter hole being tapped $T_{sh}$ (Tapped hole)—and each includes a wire-clamping screw 19*a*. Wire-securing devices 19 may take any of various other forms.

Nut plate 20 is threaded for a clamping screw, and the nut plate has opposite extremities received in grooves 22 in the side walls (FIG. 2) of channel 18. The extremities of nut plate 20 and the cross-section of grooves 22 (FIGS. 2 and 7) in which they are received are complementary dovetail-shaped interlocking formations. Those formations arrest the walls of the channel against spreading when the screws 20*a* in nut plate 20 are tightened against a stud terminal ST. Screws 20*a* and nut plate 20 form a clamping device that drives the stud terminal against contact surfaces of channel 18. It is understood that grooves 22 restrain the nut plate from shifting away from the bottom 18*a* of channel 18 as the clamping screw(s) 20*a* is (are) being tightened.

Connector 10 is easily assembled to a stud terminal in various ways. In one mode of assembly, the stud terminal may be laid against part of the bottom 18*a* (FIG. 5) of channel 18 while the channel is open and unobstructed by nut plate 20, and while the contact area at the bottom of the channel is thus freely accessible. Nut plate 20 may be assembled to body segment 14 and then the nut plate can be slid along grooves 22 into position opposite to the stud terminal.

In another mode of assembly, the ends of nut plate 20 may be inserted into their receiving grooves 22 in the body extrusion, with nut plate 20 adjusted to its final assembled position on body extrusion 14*a*. A slip-fit passage is then defined by nut plate 20 and the side walls and the bottom 18*a* of channel 18, while screws 20*a* are retracted. Accordingly, in this procedure for mounting the connector on a stud terminal, the connector, while bearing a nut plate 20, may be moved along the stud terminal to its desired position. Screw or screws 20*a* may then be tightened. The position of nut plate 20 remains adjustable until a screw 20*a* has been tightened.

The bottom 18*a* of channel 18 provides body 14 with an externally accessible contact surface for engagement by a stud terminal, avoiding critical design constraints such as those encountered in connectors wherein a bore is relied upon for receiving the stud terminal.

Body extrusion 14 is a cut segment (designated 14*a* in FIG. 6) of a stock of metal extrusion 14*b*. Nut plate 20 (shown in FIG. 2 in its finished condition) is also a cut segment of a stock of metal extrusion (not shown in a separate view). Each stock of the metal extrusion (for the body and for the nut plate) is uniform in cross-section all along its length, as is characteristic of metal extrusions. Secondary operations are performed on the body 14 and on plate 20 in their extruded states. The nut plate is drilled and tapped for screw(s) 20*a*.

In FIG. 2, nut plate 20 is arched upward, and it is in cooperation with a standardized 1-inch diamater stud terminal that is shown in phantom. Nut plate 20 may be inverted, then being arched downward, to cooperate with a ⅝-inch diameter stud terminal. When the nut plate is inverted for use with a ⅝-inch stud terminal, its screw(s) should correspondingly be inverted relative to the nut plate, so that the screws remain upright in use.

Figure 4:
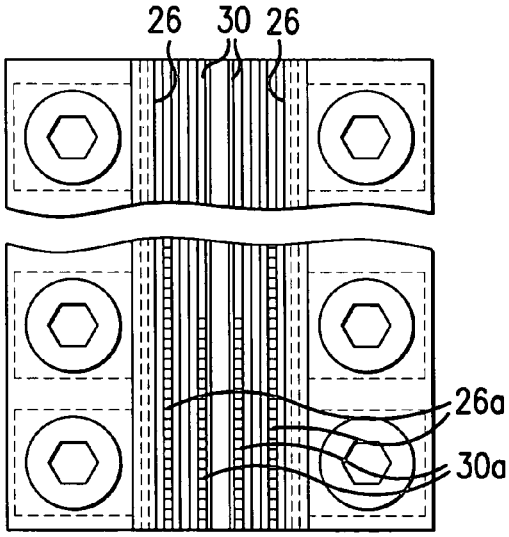
Figure 5:
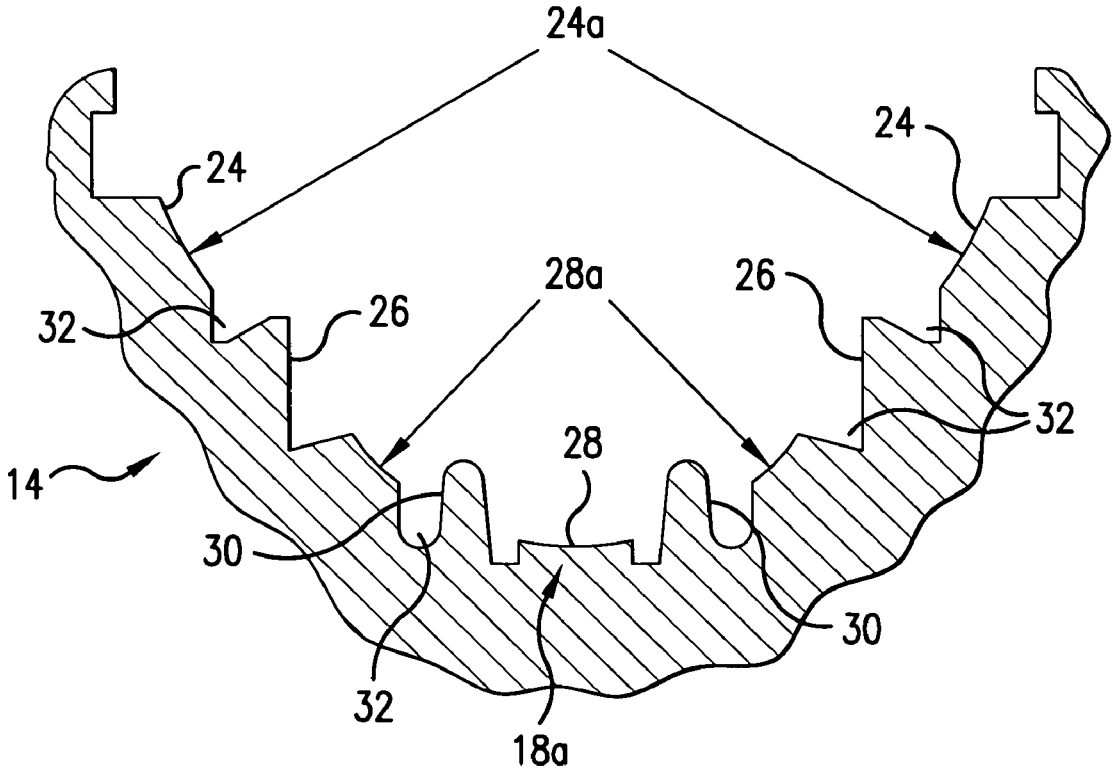

FIG. 5 is a greatly enlarged fragmentary cross-section of the bottom 18*a* of channel 18. FIG. 2 shows the as-extruded form of stock for the body extrusion. The novel illustrative connector of FIGS. 1-4 is designed for use alternatively with 1"-14 and ⅝"-11 stud terminals. A limited longitudinal portion of each rib 26 and 30 (as required by the length of the stud terminal with which it is to be used) is converted to a succession of teeth 26*a*, 30*a* (FIG. 4) by a punch or die, as described below.

Figure 6:
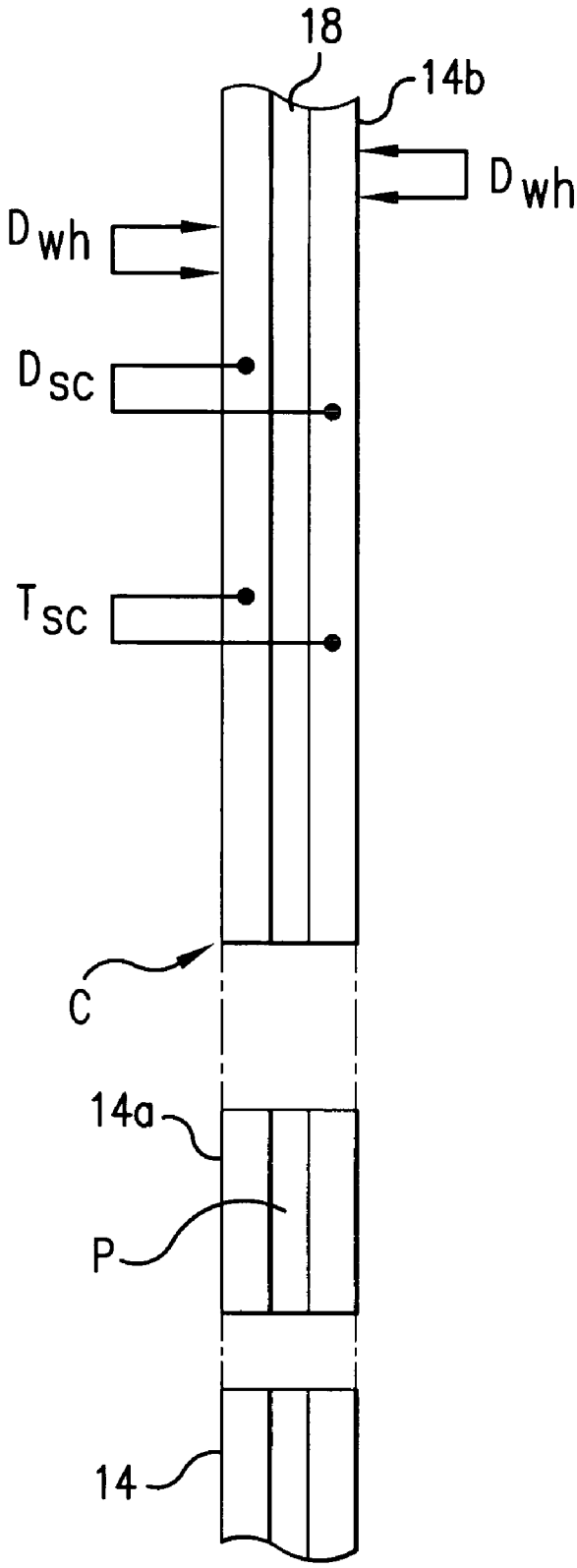

Arcs 24 in FIG. 5 represent the composite of cylindrically contoured contact areas for engagement by the spiral crest of a 1-inch stud terminal. This surface extends at a radius 24*a* all along body extrusion stock 14*b* (FIG. 6). The bottom 18*a* of channel 18 in extruded stock 14*b* includes a pair of ribs 26 which extend all along the extruded stock. The ribs project inward, i.e. to a shorter radius than radius 24*a*. The bottom of channel 18 in extruded stock 14*b* includes three arcs 28 (FIG. 5) which represent the composite of the cylindrically contoured contact areas for engagement by the spiral crest of a ⅝-inch stud terminal. These areas extend at a radius 28*a* all along extruded stock 14*b*. The bottom of channel 18 in extruded stock 14*b* includes a further pair of ribs 30 which also extend all along extruded stock 14*b* and they project inward of the contact areas (i.e., to a shorter radius than radius 28*a*).

The cross-section of the extruded stock includes a pair of crevices 32 that flank each of the ribs 26 and 30, along the length of those ribs.

Figure 3A:
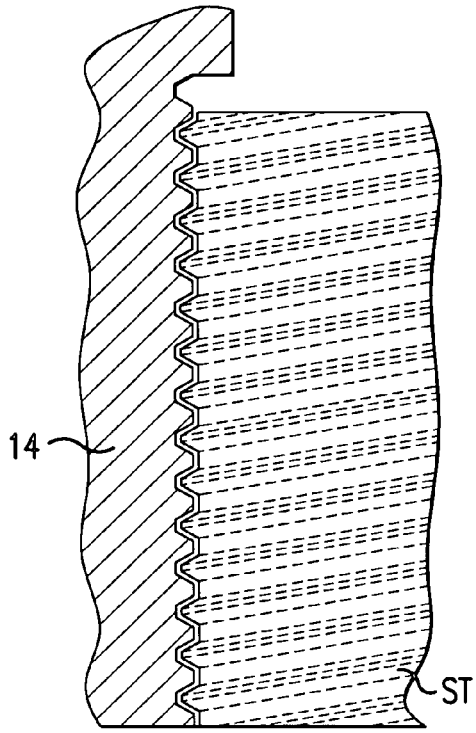
FIG. 3A is an enlarged cross-section of a portion of FIG. 3, showing a sequence of teeth in mesh with a stud terminal that is shown in phantom.
Figure 7:
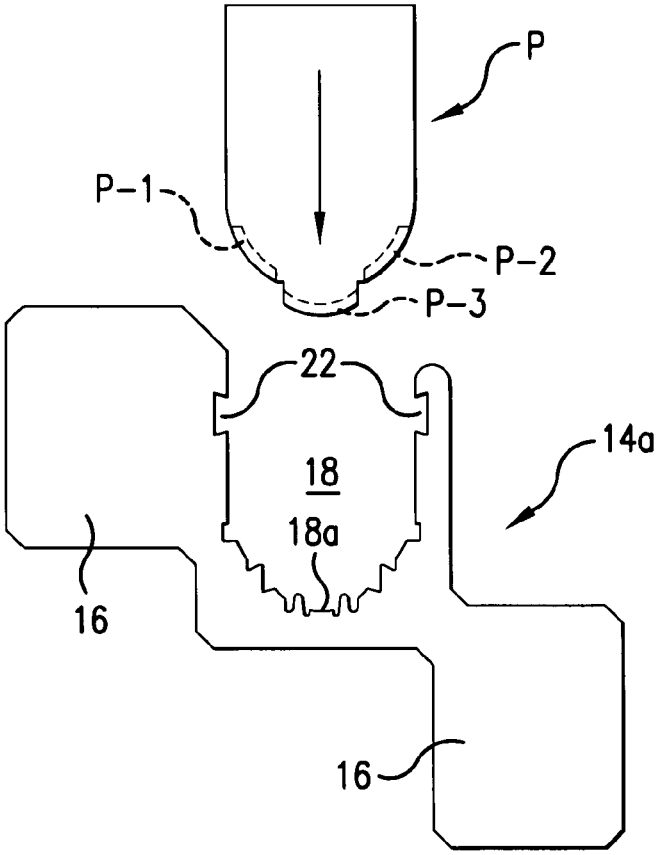
Figure 8:
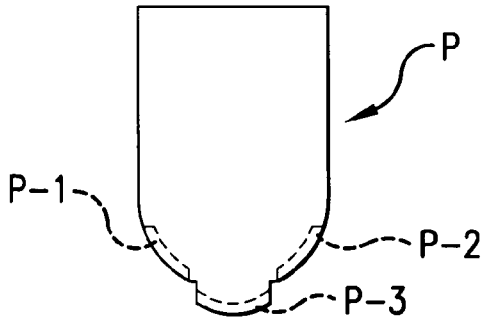

Extruded stock 14*b* is cut (C, FIG. 6) into lengths, appropriate for the number of branch-circuit fasteners of the connector to be produced. The extrusion's end view is shown in FIG. 7. Ribs 26 and 28 are converted into sequences of thread segments or teeth 26*a*, 30*a* (FIG. 4) that mesh (FIG. 3A) with the spiral thread of a stud terminal ST. A stroke of punch P (FIG. 7) effects this conversion, concurrently, of all the ribs of the body extrusion 14*a* of each connector. This conversion takes place after the body extrusion has been cut from the stock 14*b* of body extrusion as indicated in FIG. 6, but it may be performed on the stock of extrusion before the body extrusion has been cut from the stock of body extrusion. Crevices 32 adjacent each rib receive metal of the rib which flows in this tooth-forming coining operation. Conversion of the ribs into teeth is readily accomplished by means of a punch P (FIG. 8) or a die in an impact or squeezing operation, causing metal of the rib to flow away from the points where gaps are formed, in creating gaps between a succession of teeth. The punch enters the open side of the channel as is indicated by the phantom in FIG. 7. The portions P-1 and P-2 of punch P represent arcuate segments of the punch that produce the gaps that become meshed with threads of a 1"-14 stud terminal. Portion P-3 of the punch represents arcuate segments that produce gaps that mesh with the thread of a ⅝"-11 stud terminal. The metal that is forced to vacate those ribs in the coining operation flows largely into crevices 32 flanking ribs 26 and 30.

Providing ribs 26 and 30 in extruded stock 14*b* (at no cost) and converting-those ribs into successions of teeth (at nominal cost) are eminently effective in producing teeth that arrest the connector against being shifted lengthwise on a stud terminal.

The design of a transformer may be such that its upstanding stud terminals have only limited length. As is indicated in FIG. 4, it is required to convert only the lowermost portions of ribs 26 to sequences of teeth 26*a*, and to convert only the lowermost portions of ribs 30 to sequences of teeth 30*a*. Each row of teeth should be at least as long as the stud terminal that is to be laid into channel 18. Pairs of ribs 26 and 30 are found in the illustrative embodiment. It may be judged that only a single row of teeth may suffice, rather than a pair of rows of teeth.

FIGS. 9-12 represent the second illustrative form of connector embodying aspects of the invention. In common with the connector of FIGS. 1-4, the connector of FIGS. 9-12 comprises two main metal parts both of which are cut segments of respective stocks of extruded metal. In the second illustrative embodiment, the portion of the connector body where branch-circuit connection devices are provided extends endwise from the portion of the connector body that receives the stud terminal.

Figure 9:
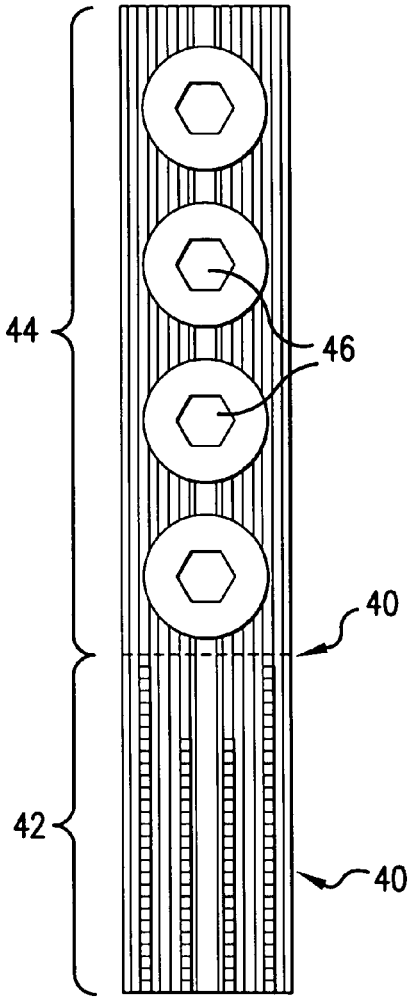
FIGS. 9-12 Show a Second Illustrative Novel Electrical Connector.
Figure 10:
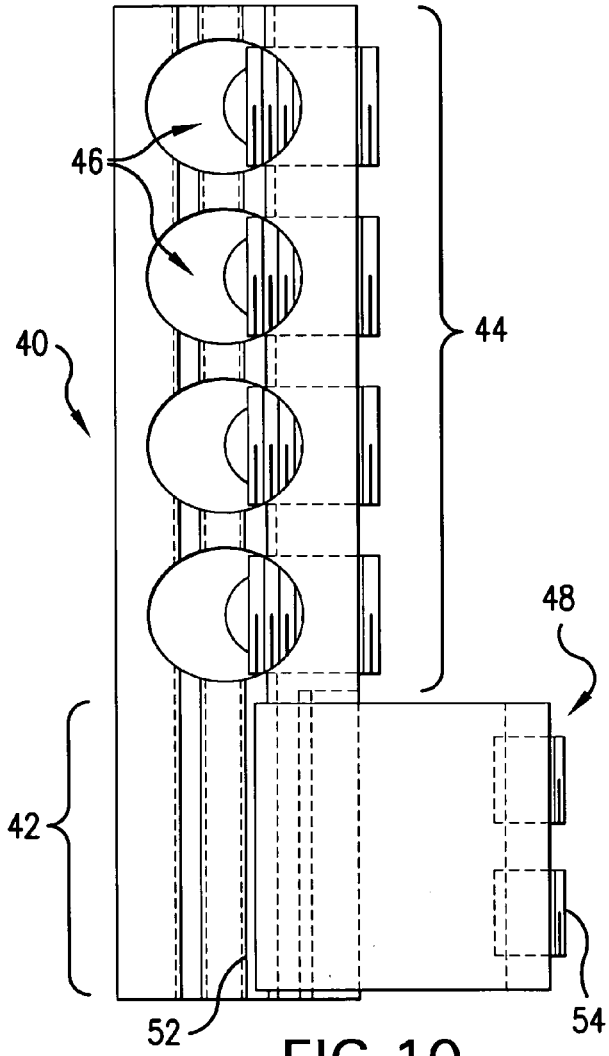
Figure 12:
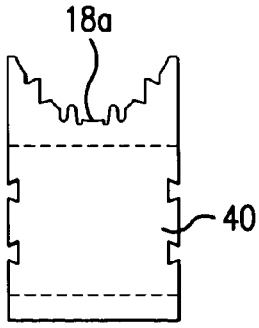
Figure 11:
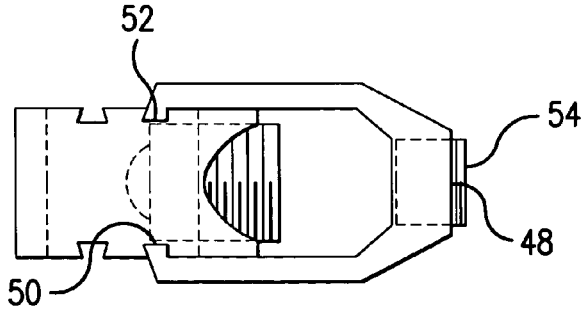

A first portion 42 of connector body 40 provides for connection to a threaded stud terminal, and a second portion 44 provides devices 46 for connecting branch circuits. Each device 46 comprises a wire-receiving bore that. receives a branch circuit wire, and a cross-drilled and tapped bore for a wire-clamping screw. FIG. 12 is the end view of a connector body extrusion 40. As extruded, the upper surface of body extrusion 40 is essentially that shown in FIG. 5. As seen in FIG. 9, the lower portion 42 of the body extrusion is modified by punch P to provide four rows of teeth. One pair of those rows of teeth is to mesh with the threads of a 1"-11 stud terminal and the other pair of rows of teeth is for mesh with a ⅝"-14 stud terminal.

Nut plate 48 (FIGS. 10 and 11) has dove-tail extremities 50. These extremities are received slidingly in complementary grooves 52 that extend all along connector body 40. The stud terminal is fixed between the nut plate and the connector body when the nut plate's screws 54 are tightened. The connector body and the nut plate form a slip-fit passage for receiving the stud terminal. In the interest of conciseness, the specifics of the contact area and the method of producing the second illustrative embodiment of the invention in FIGS. 9-12 are not described; they are essentially the same as in the embodiment of FIGS. 1-4.

Figure 13:
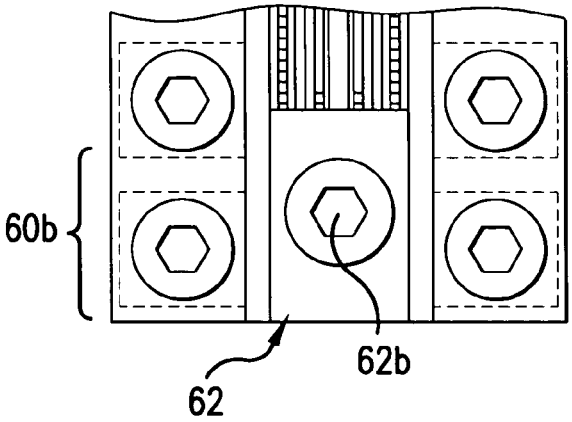
FIGS. 13-15 are Views of the Third Novel Illustrative Electrical Connector.
Figure 14:
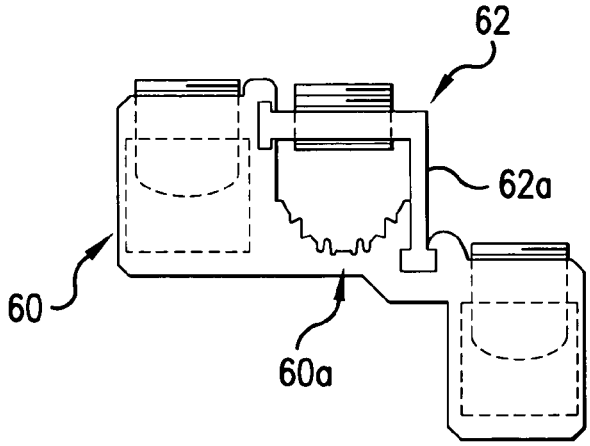
Figure 15:
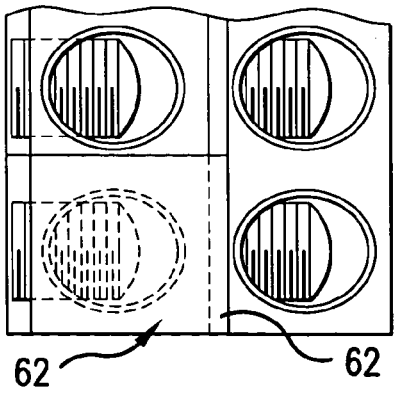

FIGS. 13-15 show a third illustrative connector embodying aspects of the invention. Almost all of the specifics of the connector in FIGS. 1-4 and its method of manufacture are essentially the same as the structure and method of manufacture of the connector of FIGS. 13-15, so that repetition is avoided in the interest of conciseness.

The end view of the stock of body extrusion 60 (FIG. 14) includes contact area 60*a* which corresponds to contact area 18*a*. The lowermost portion of the body extrusion has two pairs of rows of teeth, as described above, to mesh with standard threaded stud terminals 1"-11 and ⅝"-14. Contact area 62 is an external surface of the connector body, open and accessible for entry of a tooth-forming punch, and it is open and accessible for the connector to be brought into confrontation with a stud terminal to receive the stud terminal.

Nut plate 62 is a segment of a stock of extrusion, having a horizontal upper portion that spans the contact area and a vertical portion 62*a*. Opposite extremities of the nut plate have formations that are received in complementary grooves in the body extrusion, allowing the nut plate to slide along the grooves but being interlocked with the body extrusion so as to block the nut plate from shifting in the direction away from the contact area when clamping screw 62*b* is tightened against a stud terminal. The connector of FIGS. 13-15 may be assembled to a stud terminal in either manner described above in relation to the connector of FIGS. 1-4.

It is evident that the illustrative embodiments and the method steps of the invention are subject to endless modification by those skilled in the art, so that the appended claims should be interpreted broadly, consistent with their spirit and scope.

What is claimed is:

1. An electrical connector connecting a threaded stud terminal of an electrical equipment to multiple branch circuits, the threaded stud terminal having a length and threads, said connector comprising:

a) an elongated metal body having a length, including multiple branch circuit securing devices that extend along part of the length of said elongated metal body, and a contact surface open along another part of the length of the elongated metal body opposite the multiple branch circuit securing devices and confronted sidewise by the threaded stud terminal in a direction perpendicular to the length of the threaded stud terminal, said contact surface having formations along the length of the elongated metal body and the formations matingly engaging the threads on the threaded stud terminal when confronted sidewise by the stud terminal; and b) a clamping device including a nut plate spanning the contact surface and interlocking the elongated body so as to be blocked against shifting in the direction away from said contact surface, the clamping device having at least one clamping screw to drive the stud terminal against said contact surface.

2. An electrical connector as in claim 1 wherein said contact surface and said nut plate define, at least in part, a slip-fit passage for admitting a stud terminal during one mode of assembly of the connector to said stud terminal and said contact surface being open to be confronted by a side of said stud terminal during another mode of assembly.

3. An electrical connector as in claim 1, wherein said metal body and said nut plate are segments of respective stocks of metal extrusions.

4. The electrical connector of claim 1 having multiple elongated metal bodies, each elongated metal body having a length and including multiple branch circuit securing devices along its length, the contact surface being shared by and bridging the elongated metal bodies, and the contact surface disposed along the lengths of the elongated metal bodies and opposite the multiple branch circuit securing devices.

5. An electrical connector as in claim 1, wherein said body is a metal extrusion.

6. An electrical connector as in claim 5, wherein said metal body has a row of integral metal teeth or by multiple accurately spaced rows of integral metal teeth, in mesh with convolutions of the threaded stud terminal, arresting said connector against being shifted along the length of the stud terminal.

* * * * *